US007366318B2

(12) United States Patent
Nevill

(10) Patent No.: US 7,366,318 B2
(45) Date of Patent: Apr. 29, 2008

(54) SUSPENSION FOR THE VOICE COIL OF A LOUDSPEAKER DRIVE UNIT

(75) Inventor: Stuart Michael Nevill, Welling (GB)

(73) Assignee: B&W Loudspeakers Limited, Sussex (GB)

( * ) Notice: Subject to any disclaimer, the term of this patent is extended or adjusted under 35 U.S.C. 154(b) by 222 days.

(21) Appl. No.: 10/526,544

(22) PCT Filed: Sep. 1, 2003

(86) PCT No.: PCT/GB03/03771

§ 371 (c)(1),
(2), (4) Date: Mar. 17, 2005

(87) PCT Pub. No.: WO2004/023840

PCT Pub. Date: Mar. 18, 2004

(65) Prior Publication Data

US 2005/0244031 A1 Nov. 3, 2005

(30) Foreign Application Priority Data

Sep. 4, 2002 (GB) ..... 0220575.5

(51) Int. Cl.
*H04R 25/00* (2006.01)

(52) U.S. Cl. ..... 381/403; 381/404

(58) Field of Classification Search ..... 381/396, 381/400, 403, 404, 405, 409, 410; 181/171–172; 29/594, 609.1
See application file for complete search history.

(56) References Cited

U.S. PATENT DOCUMENTS

| | | | | |
|---|---|---|---|---|
| 4,353,432 | A | 10/1982 | Hasegawa et al. | |
| 6,853,734 | B2 * | 2/2005 | Sahyoun | 381/404 |
| 7,006,652 | B2 * | 2/2006 | Tomiyama et al. | 381/404 |

FOREIGN PATENT DOCUMENTS

| | | |
|---|---|---|
| EP | 1 241 917 A2 | 9/2002 |
| GB | 0 694058 | 7/1953 |
| GB | 2 166 023 | 4/1986 |
| JP | 550003232 | 1/1980 |
| JP | 9-275598 | * 10/1997 |
| JP | 09 275598 | 10/1997 |
| WO | 91 06191 | 2/1991 |

* cited by examiner

*Primary Examiner*—Huyen Le
(74) *Attorney, Agent, or Firm*—Buchana Ingersoll & Rooney PC

(57) ABSTRACT

A suspension, for the voice coil of a loudspeaker drive unit, includes an inner ring to be connected to the voice coil of the loudspeaker drive unit; an outer ring to be connected to the chassis of the loudspeaker drive unit; and a plurality of radial spoke-like members connecting the inner ring to the outer ring. The radial spoke-like members are free of compressive stress between their ends. The spoke-like members are of greater lateral stiffness than the spoke-like member's and are substantially X-shaped.

22 Claims, 3 Drawing Sheets

PRIOR ART

SUSPENSION FOR THE VOICE COIL OF A LOUDSPEAKER DRIVE UNIT

This invention relates to suspensions for the voice coils of loudspeaker drive units.

FIG. 1 is a diagrammatic cross-section though a typical loudspeaker drive unit of the prior art. The drive unit comprises a chassis 1, a roll surround 2, a cone-shaped diaphragm 3, a suspension 4 for the voice coil (also called the rear suspension or spider), and a 10 dust dome 5. The voice coil assembly comprises a coil former 6 leading down from the diaphragm 3 to the coil 20 in the gap between a top plate 7 and a pole piece 22. The drive unit also comprises a permanent magnet 8 and a back plate 9.

Such a moving coil loudspeaker drive unit thus has two suspension mechanisms, namely, the outer suspension in the form of the illustrated annular "roll" of rubber 2, and the inner, rear or voice coil suspension 4 usually called a "spider" and usually in the form of a disc made of woven fibres impregnated with resin and formed with annular corrugations. Both suspensions are intended to allow the diaphragm to move axially inward and outwards while at the same time preventing (a) radial expansion or (b) lateral movement comprising 25 translation of the coil and the diaphragm away from the axis of movement or (c) rocking of the coil former or (d) rotational movement of the voice coil relative to the chassis.

The primary function of the outer suspension is, however, to prevent the "out of phase" radiation from the rear of the diaphragm coming round to the front and thus cancelling out the desired front radiation and the primary function of the rear suspension is to provide the restoring force necessary to maintain the axial equilibrium position where the voice coil rests centrally in the gap and is located symmetrically about the magnet assembly's top plate. The outer suspension also provides some stiffness which assists in maintaining the axial equilibrium position, but to a much smaller degree. The total stiffness present combines with the mass of the moving parts to form the fundamental resonance frequency of the drive unit. This is an important speaker parameter of the drive unit.

The total restoring force should be as linear as possible and should adhere to Hooke's law up to the longest possible "throw" of the voice coil/diaphragm assembly away from the central axial rest position. Preferably, there should also be some "soft clipping"action outside this "Hooke's law range" which prevents the coil leaving the gap or, so to speak, "banging against the back stops". This soft clipping should be achieved while still allowing the maximum linear "throw"and should produce the minimum possible distortion until the coil actually reaches a limit either fully inwards or fully outwards.

In the earliest loudspeaker drive units, the rear suspension consisted of several spiral strips of flat metal connecting the inner voice coil former to the outer chassis. This resembled a spider in appearance and the term "spider" has persisted in the art. This spiralling flat metal strip construction allowed axial movement and to some extent prevented any lateral movements of the diaphragm/coil.

The use of spiral strips of metal meant, however, that there was a tendency for the coil to rotate around the axis as the diaphragm/coil moved inwards and outwards. Furthermore, the metal strips did not allow much, if any, linear axial restoring force to be achieved, and they had a tendency to resonate along their lengths since they had little bending stiffness in that direction. Such constructions were quickly abandoned for the more familiar woven fibre corrugated discs used today.

The "spiders" used today are usually made of woven fabric which has been impregnated with resin to provide the desired stiffness and hence resonance frequency of the assembly. They do provide lateral stiffness while allowing axial movement, but the woven fabric construction does still suffer from a number of severe disadvantages:

1. The spider itself is a radiating diaphragm as is the speaker diaphragm above it, and so the spider radiates sound. Some of this "spider sound" passes through the speaker diaphragm (which ought to be the sole radiator of sound) and colours the resulting sound output from the entire system.

2. The spider's shape does not offer much "shape stiffness" to standing bending waves. Therefore, at even moderately high frequencies the spider exhibits a multitude of resonances which cause the resulting radiated sound to have a series of peaks and dips throughout its spectrum. These resonant peaks and dips, together with their tendency to store energy and give it out at the wrong time (that is, after the excitation has finished) further colours the sound from the whole system.

3. The spider resonances also directly affect the movement of the voice coil itself as the acoustic impedance at the end of the spider that is attached to the voice coil former changes markedly in the neighbourhood of each resonance, and this directly affects the sound radiated from the speaker diaphragm.

4. The axially corrugated woven fibre spider also exhibits a non-linear axial restoring force. This results in distortion which increases rapidly with the magnitude of the diaphragm excursion It has also been proposed to make the spider of snap-acting over-centre springs to assist the loudspeaker diaphragm motion. When this negative spring action is combined with the positive stiffness of the air in the enclosure of the loudspeaker, the result is a combined spring with less of a positive spring constant. One example is to be found in our patent specification GB 2 348 563 where the spider resembles a cartwheel of which the spokes are bowed strips of material in compression between the hub and the rim. Such spiders have the disadvantage that they require a special arrangement to set the neutral position of the spider.

It is an object of the invention to provide a suspension for the voice coil of a loudspeaker drive unit which enables disadvantage of the prior art to be reduced or overcome.

The present invention provides a suspension for the voice coil of a loudspeaker drive unit, the suspension comprising:

an inner ring to be connected to the voice coil of the loudspeaker drive unit;

an outer ring to be connected to the chassis of the loudspeaker drive unit; and a plurality of radial spoke-like members connecting the inner ring to the outer ring; wherein the radial spoke-like members are free of compressive stress between their ends. Such a construction provides a smaller radiating area than a conventional corrugated woven fabric spider. As already mentioned, spiders radiate sound and that sound is usually full of resonances. By reducing the radiating area and better construction, the invention can reduce both the resonances and their effect. A construction according to the invention is capable of producing less distortion than conventional spiders of doped woven fabric pressed into a series of axi-symmetric corrugations since the axial centring force they produce is very non-linear.

Both the spider constructions of the prior art and that of the invention prevent lateral movement while allowing axial movement. Since the suspension according to the invention comprises a series of spoke-like members, the moving volume of air generated by the frontal area of each is substantially cancelled out by that from the rear surface of the same spoke-like member. In a conventional construction, the corrugated impregnated woven fibre construction represents a baffle which prevents the rear radiation from coming to the front and cancelling the front radiation. This uncancelled front radiation then subsequently passes through the diaphragm. The spoke-like construction consists therefore of a series of small "radiation inefficient" dipoles rather than the single large frontward facing efficiently radiating monopole that is usually present.

The spoke-like construction either removes, or greatly reduces, the effects found in ordinary spiders as described (1) to (4) above. The total radiating area of the spokes can be greatly reduced relative to that of a solid woven fibre axially corrugated standard spider construction, thus reducing greatly the "spider radiation" as well. As the spokes are free of compressive stress, they do not exhibit any negative spring constant at all and there is no need of a special arrangement to maintain a neutral position.

Advantageously, the radial spoke-like members are in tension between the inner and outer rings. Such a construction is capable of removing some of the distortion resulting from the change in the effective volume of the loudspeaker enclosure as the diaphragm moves into and out of the enclosure. When the spokelike members are in tension, a beneficial effect occurs whereby some of the non-linearity caused by the air in the box is partially cancelled out.

Whether the spoke-like members are free of all stress or pre-stressed in tension, there is a stable rest position at the centre of the movement which maintains the voice coil symmetrically about the magnet top plate without the need for any complicated arrangement to set the neutral position.

Preferably, the spoke-like members are connected to each ring by a respective hinge member. Such an arrangement facilitates the desired axial movement of the voice coil.

The spoke-like members may have a hinge member at each end and the hinge members and the rings may all be made of plastics material. The hinge members may consist either of a separate hinge construction, or a thinning of the radial strip itself thus forming a bendable hinge.

The use of relatively stiff plastic strips to form the spoke-like members, with hinges at each end, represents an inherently more linear construction than the axially corrugated woven impregnated fibres more usually found in voice coil suspensions.

Thus, the hinge members may comprise webs of material integrally joined to the spoke-like members and rings.

Preferably, the spoke-like members are of striplike form, the surfaces of the strips being arranged broadside on to the front and back of the suspension.

Preferably, the spoke-like members are arcuate as viewed in a circumferential direction. The curvature of these strips imparts a bending rigidity to the strips themselves and helps prevent them "breaking up" into their own series of resonances along their lengths. The spoke-like members can be free of either compression or tension and just formed into arcs of circles.

The spoke-like members may comprise members of which the arcs face forwards along the longitudinal axis of the suspension and an equal number of members of which the arcs face backwards.

Preferably, the members are arranged with forward and backwards facing arcs alternating. This has the effect of making the inward and outward movements of the inner ring identical in terms of linearity, and so removes "harmonic" distortions and mechanical rectification producing DC-like position shifting effects as a consequence.

The members may be arranged in pairs with forward and backing facing arcs overlying each other as seen looking along the longitudinal axis of the suspension. In practice, this may take the from of a "double strip"with the forwardly-bowed and backwardly-bowed strips connected to the same points on the inner and outer ring Advantageously, the spoke-like members have a width approximately equal to their length. Such a construction is of value for providing lateral stiffness when the gap between the inner and outer rings is small relative to the diameter of the inner ring.

Preferably, further included are spoke-like members of a different construction and greater lateral stiffness to that of the first-mentioned spoke-like members.

The spoke-like members of greater lateral stiffness may be of a forked construction at at least one of their ends.

The forked construction may be of two-pronged form.

Preferably, the spoke-like members of greater lateral stiffness are forked at both ends.

The spoke-like members of greater lateral stiffness may be substantially X-shaped.

Preferably, the spoke-like members of greater lateral stiffness are angled as viewed in a circumferential direction.

The angling of alternate spoke-like members of greater lateral stiffness may be reversed from one to the next.

In an illustrated embodiment of the invention, these further spoke-like members are X-shaped constructions arranged between each pair of alternately bowed spokes. The X-shaped members are hinged at their mid-points and at each end. They serve to prevent lateral movement and to prevent the inner ring from rotating about the axis relative to the outer wheel, while still allowing the axial movement of the inner ring, which, in use, is connected to the speaker diaphragm, at the voice coil.

As illustrated, between each bowed strip is an "X "like construction of two crossed straight sided strips which may again be made of plastics material. As stated, these have a hinge at each end and a hinge in the middle. This construction provides rigidity against the inner ring's lateral movement and twisting relative to the outer ring. The X's may alternate between being inwardly and outwardly placed as with the "spokes", thus preserving the symmetry of the inward and outward movement of the construction.

Preferably, the spoke-like members of greater lateral stiffness are connected to each ring by a respective hinge member.

The hinge members of the spoke-like members of greater lateral stiffness may comprise webs of material integrally joined to the said spoke-like members and rings.

Each spoke-like member of greater lateral stiffness may include a respective hinge member mid-way along its length.

The hinge members mid-way along the length may comprise webs of material integrally joined to the associated spoke-like members.

Preferably, the first-mentioned spoke-like members are made of a resilient material. This construction provides a simple means of obtaining a restoring force for axial movement.

The resilient material may comprise plastics material, impregnated fabric, or metal.

Preferably, the hinge members are made of an elastomeric material. Such a construction is well suited to the stresses of repeated flexing.

The elastomeric material may be a thermoplastic polyester elastomer.

The hinge members may be made of a different material from the remainder of the spoke-like members. Such a construction enables a material of good stress resistance to be used for the hinge members and a material with a more linear spring characteristic to be used for the body of the first-mentioned spoke-like members.

The body of the spoke-like members of greater lateral stiffness may be made of plastics material.

The whole suspension may be made of plastics material and all parts, for some applications, may be formed at the same time by, for example, injection moulding.

The invention also provides a suspension for the voice coil of a loudspeaker drive unit, the suspension comprising:

an inner ring to be connected to the voice coil of the loudspeaker drive unit;

an outer ring to be connected to the chassis of the loudspeaker drive unit; and a plurality of radial spoke-like members connecting the inner ring to the outer ring, wherein further included are spoke-like members of a different construction and greater lateral stiffness to that of the first-mentioned spoke-like members.

Suspensions according to the invention will now be described, by way of example only, with reference to the accompanying drawings, in which.

Figure 1:
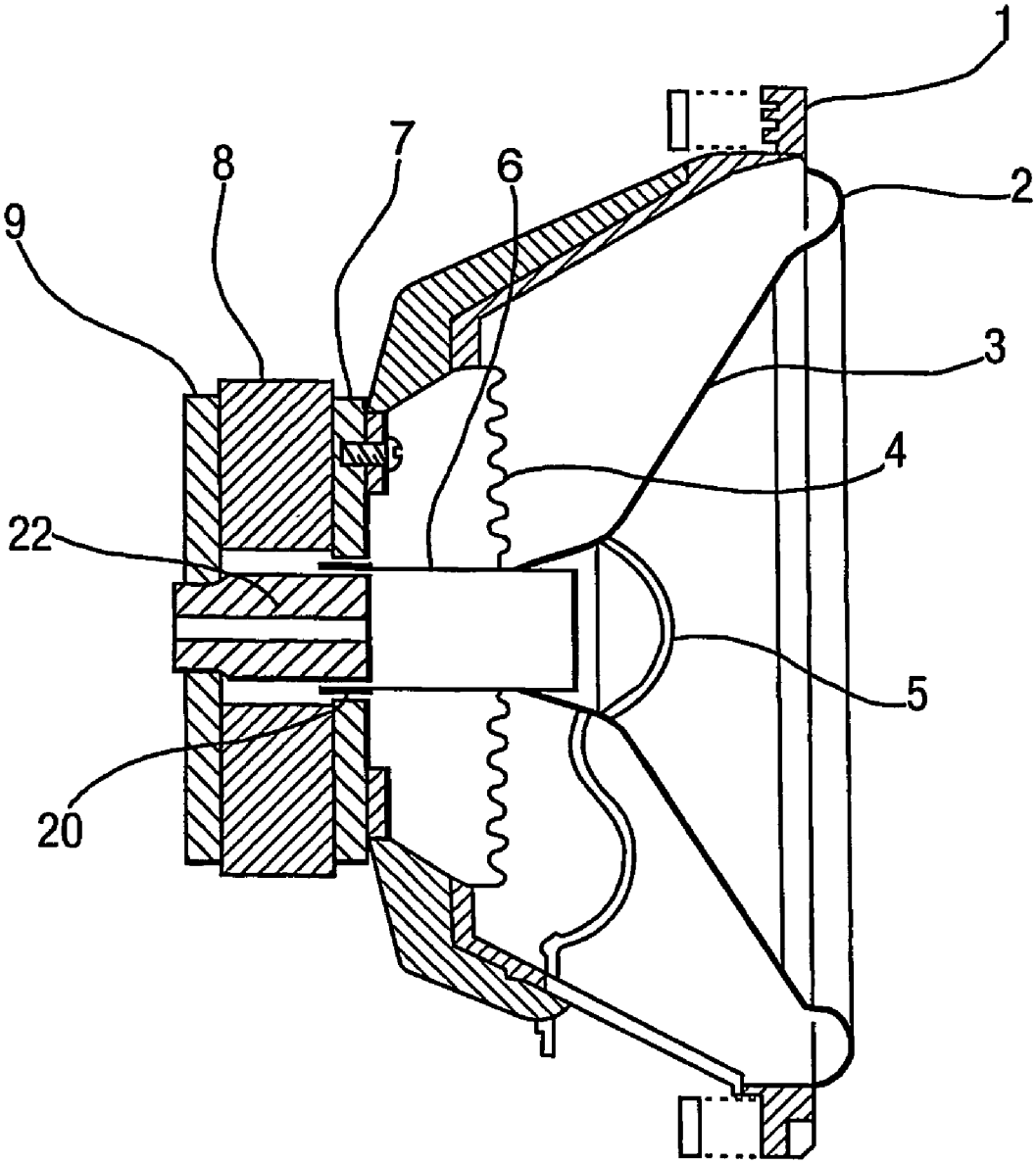
FIG. 1 is a diagrammatic cross-section through a loudspeaker drive unit of the prior art.
Figure 2:
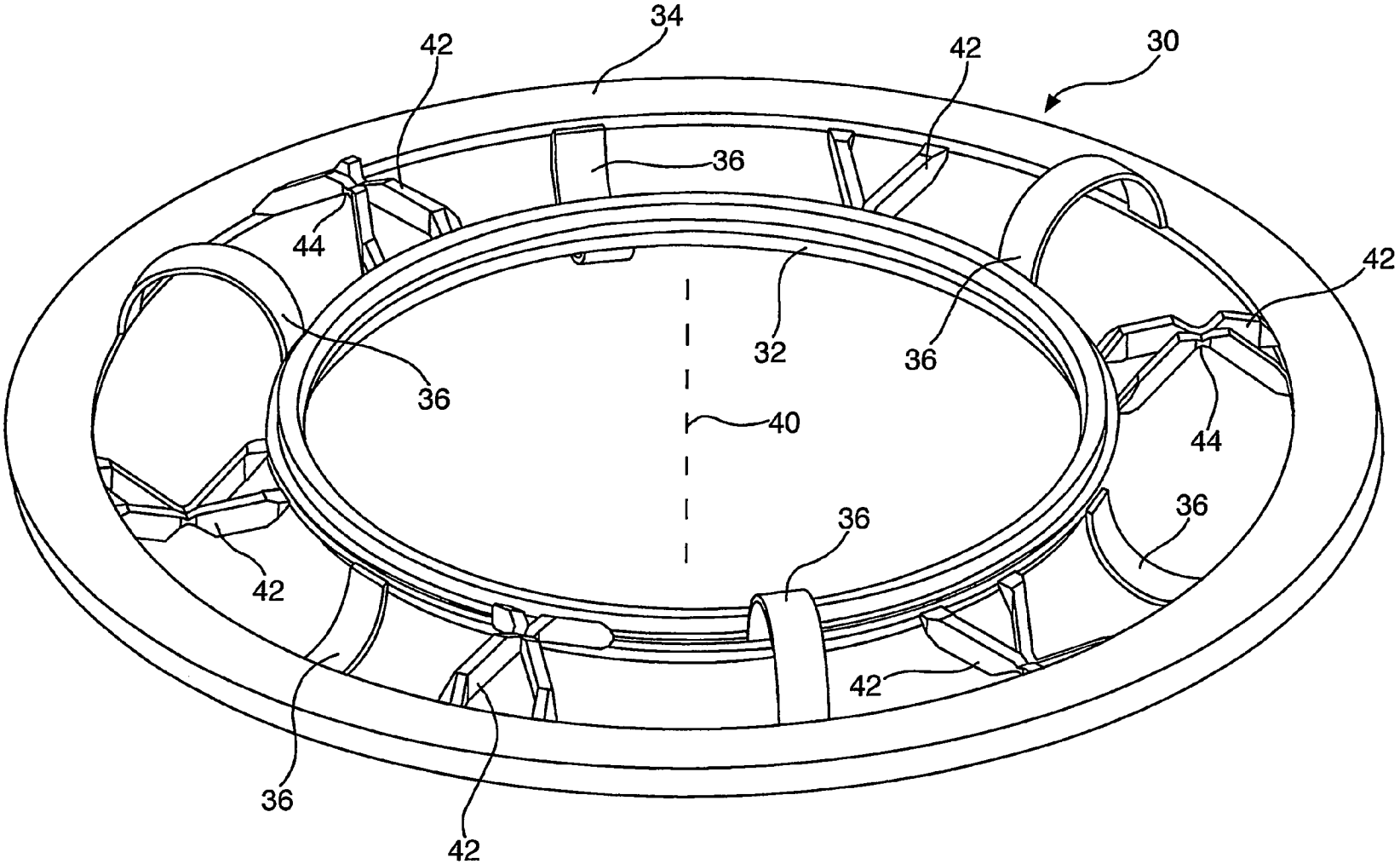
FIG. 2 is a diagrammatic perspective view of a suspension according to the invention, the suspension being shown lying in a horizontal plane for viewing rather than in use.

Referring to FIG. 2 of the accompanying drawings, a suspension 30 for the voice coil of a loudspeaker drive unit comprises an inner ring 32 to be connected to the voice coil of the loudspeaker drive unit and an outer ring 34 to be connected to the chassis of the loudspeaker drive unit. Six bowed, radial spoke-like members 36 of a resilient plastics material connect the inner ring 32 to the outer ring 34. The radial spoke-like like members 36 are not only free of compressive stress between their ends but, in fact, are in tension between the inner and outer rings. That is to say, the ends of the members 36 are pulled further apart from each other by their attachment to the rings 32 and 34 than they would naturally be if they were not attached to the rings. That can be achieved by deforming the members 36 against their natural resilience while they are being attached to the rings 32 and 34.

Figure 3:
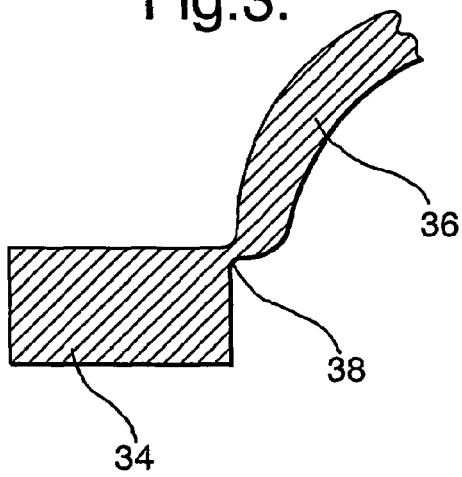
FIG. 3 is a fragmentary sectional view showing the construction of a hinge member.

The spoke-like members are connected to each ring by a respective hinge member 38 illustrated schematically in FIG. 3. The hinge members 38 comprise webs of material integrally joined to the spoke-like members 36 and rings 32 and 34.

The spoke-like members 36 are of strip-like form, the strips being arranged broadside-on to the front and back of the suspension. The spoke-like members 36 are arcuate as viewed in a circumferential direction and there are three members of which the arcs face forwards along the longitudinal axis 40 of the suspension and three of which the arcs face backwards. As shown, the members 36 are arranged with forward and backwards facing arcs alternating.

Figure 4:
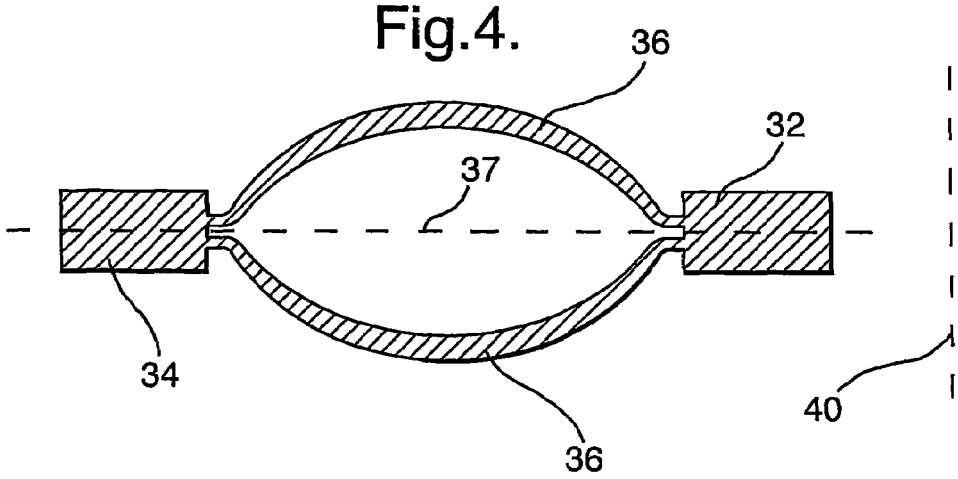
FIG. 4 is a fragmentary sectional view (one side of the longitudinal axis) showing a construction with overlying members.

FIG. 4 shows schematically an alternative arrangement in which the members 36 are arranged in pairs with forward and backing facing arcs overlying each other as viewed in a circumferential direction. Conveniently, this construction can be made in two parts joined together on the line 37.

Figure 5:
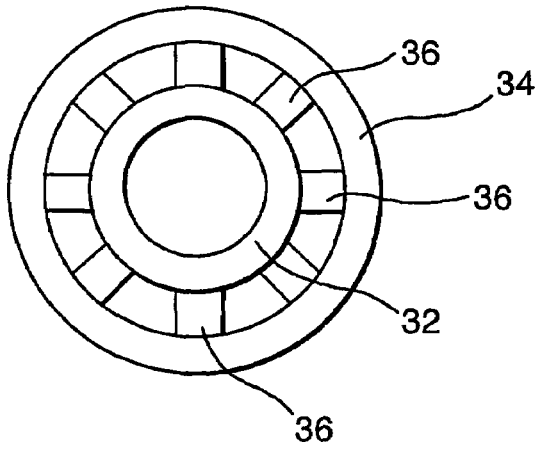
FIG. 5 is a diagrammatic end view showing the use of members with a particular length to width ratio.

The members 36 shown in FIG. 2 are long compared with their width (measured in a circumferential direction). FIG. 5 illustrates schematically that it is possible to make an arrangement in which the spoke-like members 36 have a width approximately equal to their length, this arrangement providing good lateral stiffness.

The suspension 30 further includes six spoke-like members 42 of a different construction and greater lateral stiffness to that of the first-mentioned spoke-like members 36. The spoke-like members 42 of greater lateral stiffness are of a two-pronged forked construction at each of their ends by virtue of the fact that they are substantially X-shaped.

The spoke-like members 42 of greater lateral stiffness are connected to each ring by a respective hinge member comprising a web of material integrally joined to the said spoke-like members and rings 32 and 34. As this corresponds essentially to the form of the hinge members 38, it is not illustrated again. The members 42 are made of plastics material and, except where a hinge is provided, have sufficient cross-sectional area to be rigid.

Each spoke-like member 42 of greater lateral stiffness includes a respective hinge member 44 mid-way along its length and comprising a web of material integrally joined to the associated spoke-like member.

The spoke-like members 42 of greater lateral stiffness are angled as viewed in a circumferential direction. As can be seen in FIG. 2, the angling of alternate spoke-like members 42 of greater lateral stiffness is reversed from one to the next.

The illustrated construction allows the diaphragm to move axially inward and outwards while at the same time preventing (a) radial expansion or (b) lateral movement comprising translation of the coil and the diaphragm away from the axis of movement or (c) rocking of the coil former or (d) rotational movement of the voice coil relative to the chassis.

Although the members 36 have been described as being made of resilient plastics material it is possible to make them of other resilient material such as metal or resin-impregnated fabric.

Examples of Preferred Dimensions and Materials

The invention is applicable to voice coil suspensions for tweeters, mid-range units, bass units and sub-woofers. The dimensions chosen will depend on the kind of loudspeaker drive unit for which the suspension is intended.

For a tweeter or mid range unit, the inner ring could, for example, have a diameter in the range 20 to 50 millimetres. For a bass unit or sub-woofer, the inner ring could, for example, have a diameter in the range 20 to 150 millimetres.

The radial gap between the inner and outer rings, could, for example, be between one third and two thirds the diameter of the inner ring.

The spoke-like members 36 could, for example, be made from strips of plastics material of thickness between 1 and 5 millimetres depending on the intended application.

It is preferred to use a thermoplastic polyester elastomer capable of resisting high stress and repeated flexing, such as HYTREL® from Du Pont for the hinge members, and to use a different material for the remainder of the spoke-like members. For example, the remainder of the members 36 can be made of a material with a more linear spring characteristic than HYTREL® such as a metal, for example, aluminium, polystyrene, or poly vinyl chloride plastics material such as that sold under the trade name Cobex.

The total number of members interconnecting the inner and outer rings can, for example, be between four members and twenty members.

As illustrated, the outer rim's rotating relative to the inner rim additional lateral stiffness is prevented by a series of 'X" like structures having hinges at their inner outer and central connections, thus allowing axial movement while substantially preventing lateral movement. Other constructions which provide stiffness to lateral movement, while allowing relatively unimpaired axial movement could, however, instead be used. The illustrated construction effectively separates and concentrates the lateral and axial stiffness functions into separate components. It is conceivable, however, that the function of the X-shaped members could be combined with the bowed spoke-like members to provide both a certain degree of axial stiffness and a much higher degree of lateral stiffness and also a high degree of bending stiffness along their lengths. For example, the width of the bent radial strips could be increased substantially to provide more stiffness in a lateral direction in the aim of completely preventing any lateral movement and bending modes along the radial directions whilst still allowing controlled axial movement. The illustrated construction, however, effectively separates these functions out into separate components thus allowing their easier independent control and specification.

The invention claimed is:

1. A suspension for a voice coil of a loudspeaker drive unit, the suspension comprising:

an inner ring to be connected to the voice coil of the loudspeaker drive unit;

an outer ring to be connected to a chassis of the loudspeaker drive unit;

a first plurality of radial spoke-like members connecting the inner ring to the outer ring; wherein the spoke-like members are arcuate as viewed in a circumferential direction and the spoke-like members comprise members of which the arcs face forwards along the longitudinal axis of the suspension, an equal number of members of which the arcs face backwards, and the members are arranged with forward and backwards facing arcs alternating;

wherein said suspension further includes spoke-like members of a different construction and greater lateral stiffness to that of the first plurality of spoke-like members.

2. A suspension as claimed in claim 1 wherein the radial spoke-like members are in tension between the inner and outer rings.

3. A suspension as claimed in claim 1, wherein each spoke-like member of greater lateral stiffness includes a respective hinge member mid-way along its length.

4. A suspension for the voice coil of a loudspeaker drive unit, the suspension comprising:

an inner ring to be connected to the voice coil of the loudspeaker drive unit;

an outer ring to be connected to the chassis of the loudspeaker drive unit;

a plurality of radial spoke-like members connecting the inner ring to the outer ring, wherein the spoke-like members are arcuate as viewed in a circumferential direction; and a plurality of stiffening members, wherein each of the stiffening members interconnects the outer ring and the inner ring and each of the stiffening members extends between the inner and outer rings at an angle of other than 90° with respect to respective tangents of the inner and outer rings at respective points of attachment.

5. A suspension as claimed in claim 4, wherein the spoke-like members are connected to each ring by a respective hinge member.

6. A suspension as claimed in claim 4, wherein the first-mentioned spoke-like members are made of a resilient material.

7. A suspension as claimed in claim 6, wherein the resilient material comprises plastics material.

8. A suspension as claimed in claim 4, further including additional spoke-like members of a different construction and greater lateral stiffness to that of the first-mentioned spoke-like members.

9. A suspension as claimed in claim 4, wherein the radial spoke-like members are free of compressive stress between their ends.

10. A suspension as claimed in claim 4, wherein the spoke-like members comprise members of which the arcs face forwards along the longitudinal axis of the suspension, an equal number of members of which the arcs face backwards, wherein all of the arcuate members are arranged in an alternating pattern such that each forward facing arc member is separated from an adjacent forward facing arc member by a backwards facing arc member, and vice versa in a circumferential direction.

11. A suspension for a voice coil of a loudspeaker drive unit, the suspension comprising:

an inner ring to be connected to the voice coil of the loudspeaker drive unit;

an outer ring to be connected to a chassis of the loudspeaker drive unit;

a first plurality of radial spoke-like members connecting the inner ring to the outer ring, wherein each of the first plurality of radial spoke-like members has one point of attachment each for the inner ring and the outer ring;

said suspension further including additional spoke-like members of a different construction and greater lateral stiffness to that of the first plurality of spoke-like members, wherein each of the additional spoke-like members has two distinct points of attachment each for the inner ring and the outer ring.

12. A suspension as claimed in claim 11, wherein each spoke-like member of greater lateral stiffness is of a forked construction at at least one of its ends.

13. A suspension as claimed in claim 12, wherein the forked construction is of two-pronged form.

14. A suspension as claimed in claim 12, wherein the spoke-like members of greater lateral stiffness are forked at both ends.

15. A suspension as claimed in claim 14, wherein each of the spoke-like members that is of greater lateral stiffness is substantially X-shaped.

16. A suspension as claimed in claim 11, wherein the spoke-like members of greater lateral stiffness are angled as viewed in a circumferential direction.

17. A suspension as claimed in claim 16, wherein the angling of alternate spoke-like members of greater lateral stiffness is reversed from one to the next.

18. A suspension as claimed in claim 11, wherein the first plurality of radial spoke-like members are free of compressive stress between their ends.

19. A suspension as claimed in claim 11, wherein the spoke-like members of greater lateral stiffness are forked at both ends.

20. A suspension as claimed in claim 19, wherein the forked construction is of two-pronged form.

21. A suspension as claimed in claim 11, wherein the spoke-like members of greater lateral stiffness are substantially X-shaped.

22. A suspension as claimed in claim 11, wherein the first plurality of spoke-like members are arcuate as viewed in a circumferential direction and the first plurality of spoke-like members comprise members of which the arcs face forwards along the longitudinal axis of the suspension, an equal number of members of which the arcs face backwards, wherein all of the arcuate members are arranged in an alternating pattern such that each forward facing arc member is separated from an adjacent forward facing arc member by a backwards facing arc member, and vice versa in a circumferential direction.

* * * * *